US006592215B2

(12) United States Patent
Udagawa et al.

(10) Patent No.: US 6,592,215 B2
(45) Date of Patent: Jul. 15, 2003

(54) LIQUID EJECTION RECORDING HEAD

(75) Inventors: Kenta Udagawa, Kanagawa-ken (JP); Toshiaki Hirosawa, Kanagawa-ken (JP); Taiji Yoshinari, Kanagawa-ken (JP); Akifumi Kanno, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/985,112

(22) Filed: Nov. 1, 2001

(65) Prior Publication Data

US 2002/0060726 A1 May 23, 2002

(30) Foreign Application Priority Data

Nov. 2, 2000 (JP) ..... 2000-336220

(51) Int. Cl.[7] ..... B41J 2/175
(52) U.S. Cl. ..... 347/93
(58) Field of Search ..... 347/85, 86, 87, 347/93, 92

(56) References Cited

U.S. PATENT DOCUMENTS

| | | | | |
|---|---|---|---|---|
| 5,502,479 A | | 3/1996 | Ishinaga et al. | 347/93 |
| 5,784,088 A | * | 7/1998 | Ujita et al. | 347/86 |
| 5,900,898 A | | 5/1999 | Shimizu et al. | 347/93 |
| 6,082,852 A | * | 7/2000 | Soga et al. | 347/86 |

FOREIGN PATENT DOCUMENTS

| | | | |
|---|---|---|---|
| EP | 0 551 752 A | 7/1993 | |
| EP | 0 574 888 A | 12/1993 | |
| EP | 0 691 207 A | 1/1996 | |
| JP | 1133747 | 5/1989 | B41J/3/04 |
| JP | 5-345425 | 12/1993 | |
| JP | 6-238910 | 8/1994 | |
| JP | 2000141697 | 5/2000 | B41J/2/175 |

OTHER PUBLICATIONS

Tao Li, "Dependence of Filtration Properties on Stainless Steel Medium Structure," *Filtration and Separation*, Croydon, GB, vol. 34, No. 3, pp. 264–273 (Apr. 1, 1997).

* cited by examiner

*Primary Examiner*—Michael Nghiem
(74) *Attorney, Agent, or Firm*—Fitzpatrick, Cella, Harper & Scinto

(57) ABSTRACT

A liquid ejection recording head which receives liquid from one or more liquid containers mounted on a carriage, the liquid container having a press-contact member of fibrous material at a liquid outlet, the liquid ejection recording head includes a tubular member for receiving ink from the liquid container, the tubular member being provided with an upstream edge with respect to a direction of flow of the liquid therethrough; a filter provided in the tubular member and having an outer surface press-contactable to the press-contact member, the outer surface being a substantially flat surface and being outward beyond the upstream edge of the tubular member.

9 Claims, 4 Drawing Sheets

LIQUID EJECTION RECORDING HEAD

BACKGROUND OF THE INVENTION

Field of the Invention and Related Art

The present invention relates to a liquid ejection recording head for placing liquid such as ink on a recording medium such as paper.

In the field of printing apparatuses, in particular, printing apparatuses which employ an inkjet method, improvement in quality and/or speed in color recording is one of the important considerations.

In order to improve recording quality, it is necessary for a recording head to eject ink droplets that are as small as possible. In order to improve recording speed, it is necessary for an ink supply path to be smooth and stable in its ink delivery performance.

The ink ejecting performance of a recording head which ejects small ink droplets is easily affected by foreign objects which have entered the recording head. Thus, in order to prevent foreign objects from entering the recording head, the recording head may be provided with a filter, which is placed in the ink path of the recording head.

It is common knowledge that, generally, when a recording head and an ink container are integrated in the form of a cartridge, a filter is placed in a certain position in the ink supply path between the ink container and recording head, whereas when a recording head is rendered independent from an ink container, a filter is placed at one end of the ink supply tube which connects the recording head and ink container.

Shown in FIGS. 3 and 4 is the structure of the ink inlet (ink supply tube) portion of a conventional recording head, in which the recording head and ink container are independent from each other. Referring to FIG. 4, which is a sectional view of both the recording head 41 and ink container 42, the ink container 42 comprises: an external shell with an air vent 422 and an ink outlet 421; an absorbent member 423 stored in the shell; and a pressing member 307 placed in contact with the ink outlet 421 for guiding outward the ink within the ink container 42. The recording head 41 is provided with an ink inlet 301 (ink supply tube), which is a part of an ink guiding path 302 for supplying ink to an ink ejecting portion 411. The outward end of the ink inlet 301 (ink guiding path 302) is provided with a filter 303, the center portion from which protrudes slightly outward from the ink inlet 301.

FIG. 3 is an enlarged sectional view of the outward end portion of the ink guiding path 302, the ink outlet 421, and their adjacencies. Referring to FIG. 3(*c*), conventionally, the ink outlet 421 of the ink container is provided with the pressing member 307, and the ink is supplied to the recording head through the contact between the filter 303 and pressing member 307. Next, referring to FIG. 3(*b*), generally, the filter 303 is located at the outermost end of the ink guiding path 302, the periphery of the filter 303 being covered with resin, as disclosed in Japanese Laid-Open Patent Application 6-238910, to prevent the occurrences of such problems as the filter 303 becoming separated from the ink inlet 301, and fiber ends exposed at the periphery of the filter damaging the pressing member. The filter 303 is fixed to the outermost end of the ink guiding path 302 by thermally bending inward the edge of the ink inlet 301 of the recording head, which is formed of a thermoplastic resin. When the filter is placed in a manner to directly press a highly elastic absorbent member as in the case of Japanese Laid-Open Patent Application 5-345425, there will be no problem. However, in the case of a structural arrangement in which the filter is placed in a manner to directly press the pressing member of an ink container, the following problem occurs. That is, if the thermoplastic resin portion of the ink inlet, covering the periphery of the filter, projects farther toward the pressing member than the filter, the resin portion comes into contact with the pressing member which is greater in diameter than the filter, thereby preventing the filter from coming into contact with the pressing member. Thus, in such a case, the filter is shaped so that the center portion of the filter spherically bulges outward to assure that the center portion of the filter comes into contact with the pressing member (FIG. 3(*b*)). A conventional filter formed by weaving metallic fibers is flexible, but flat in its natural state. Thus, it is welded to the resin portion so that the center portion of the filter remains flexed outward of the liquid inlet. Since the filter is flexible, it deforms as it is pressed by the pressing member, preventing air from remaining (entering) between the filter and pressing member.

The filter grade should be selected according to the diameter of the orifices through which ink droplets are ejected. However, a conventional filter formed by weaving metallic fibers is not satisfactory in terms of foreign object removal performance. More specifically, in order to remove finer foreign objects, the metallic fibers must be made fine, but the finer the metallic fibers, the weaker the filter. In other words, it is difficult to make a filter which is strong and yet does not easily clog. Thus, in order to provide a filter which is strong and yet does not easily clog, it becomes necessary to replace the conventional filter material with a material that is stronger and yet is less likely to clog than the conventional filter material. Thus, a filter formed by sintered metallic fibers layered like the fibers in nonwoven fabric has come into use as a replacement for a conventional filter, due to its advantage that it is finer in mesh and its multilayer structure makes it less likely to clog. On the other hand, a sintered filter lacks flexibility, and therefore, it is difficult to make the center portion of a sintered filter permanently protrude outward of the ink inlet of a liquid ejection recording head when attaching the filter to the resinous portion of the ink inlet. Thus, a sintered filter must be shaped so that its center portion permanently protrudes in the direction corresponding to the outward direction of the ink inlet, prior to the attachment of the filter to the resinous portion of the ink inlet. As for the shape in which the center portion of a sintered filter protrudes, in the case of a sintered filter with a small diameter, for example, no more than approximately 5 mm, the center portion of the sintered filter will be in the form of a circular frustum, being flat on top, surrounded by the flat peripheral portion of the filter, in consideration of issues regarding the manufacture of the sintered filter, for example, the accuracy of the pressing process.

Further, in the case of an ink supplying member which uses capillary force to supply ink, the higher the speed at which ink must be supplied, the stronger the ink retaining force of the ink supplying member must be; and the stronger the ink retaining force of the ink supplying member must be, the stronger the capillary force the ink supply member generates must be. Conventionally, a pressing member formed by layering polypropylene fibers in the same manner as the fibers in felt are layered has been used as the aforementioned pressing member. In the case of this type of pressing member, however, the needle punch marks which were made while manufacturing this type of pressing member, and/or the density limit in the manufacturing process, made it difficult to increase the capillary force in this type of pressing member above a certain level. Thus, a pressing member formed by binding polypropylene fibers in parallel in such a manner that the fiber direction matches the ink flow direction has come into use as a replacement for a conventional pressing member, due to its advantage that it is higher in fiber density, therefore being capable of generating a stronger capillary force, and also, being capable of preventing the pressure loss from increasing.

However, the above-described filter formed by sintering is poor in flexibility compared to the woven filter; it is difficult to sinter a filter capable of conforming to the contour of the pressing member as does a conventional woven filter. Further, compared to a conventional pressing member formed of felt, a pressing member formed of bound PP fibers is higher in density, and its fibers are perpendicular to the interface between the pressing member and filter. Therefore, a pressing member formed of bound PP fibers is not as flexible as a conventional filter, at the interface, failing to making satisfactory contact with a filter, as shown in FIG. 3(*d*). In other words, when a liquid ejection recording head equipped with a sintered filter is used in combination with an ink container equipped with a pressing member formed of bound PP fibers, a number of relatively large gaps are left between the filter and pressing member, as shown in FIG. 3(*d*), adversely affecting the stability in ink delivery.

Thus, in terms of making the filter and pressing member properly contact each other, the configuration of the contact portions of the two components, and their positions relative to each other, are much more important than they used to be. Further, the contact pressure between the filter and pressing member must be properly adjusted. In other words, there is much to be improved regarding the filter for a liquid ejection recording apparatus, in terms of the stability in ink supply performance and the yield in its mass production.

During an operation for restoring the performance of a liquid ejection recording head by suctioning away the ink in, or in the adjacencies of, the ejection orifices, ink flows at a higher speed than during a normal printing operation. Thus, if the filter and pressing member are not properly in contact with each other, it is possible that air will be sucked into the ink guiding path. If air is sucked into the ink supply path by a large amount, the ink supply to the ejection orifices is interrupted, resulting in unsatisfactory printing performance.

SUMMARY OF THE INVENTION

In consideration of the above-described problems, the primary object of the present invention is to keep the filter of the ink inlet of a liquid ejection recording head properly in contact with the virtually flat contact surface of the pressing member of a liquid supply container, in order to make it possible to provide a liquid ejection recording head superior in terms of the stability in ink delivery performance and also in terms of the yield in mass production.

The present invention for accomplishing the above objects relates to a liquid ejection recording head, which is provided with a filter attached to the entrance of the ink guiding path of the recording head, and receives liquid from one or more ink containers, which are mounted on a carriage, and the liquid outlet of which comprises a pressing member, which is formed of fibers and contacts the filter of the recording head. The present invention is characterized in that the portion of the filter of the liquid ejection recording head that contacts the pressing member of the ink container (1) projects outward from the ink guiding path of the recording head, relative to the periphery of the filter by which the filter is attached to the recording head, and (2) is virtually flat. The present invention includes a liquid ejection recording head, the filter of which is a filter that is produced by sintered metallic fibers.

With the provision of the above-described structural arrangement, according to which the portion of the filter that contacts the pressing member (1) projects farther outward than does the periphery of the filter by which the filter is attached to the recording head, and (2) is rendered flat, the filter can be kept satisfactorily in contact with the virtually flat contact surface of the pressing member.

According to the present invention, a filter for the above-described liquid ejection recording head may be such a filter that even before the filter is attached to the recording head, the center portion of the filter projects outward of the ink guiding path of the recording head, relative to the periphery of the filter, and the center portion of the filter, which contacts the pressing member of an ink container, is virtually flat, or such a filter that, before it is attached to the recording head, its center portion which comes into contact with the aforementioned pressing member, spherically protrudes outward relative to its periphery, but after the filter is fixed to the entrance of the ink guiding path of the liquid ejection recording head, its center portion is made flat by pressing.

Further, in order to prevent air bubbles from entering the liquid ejection recording head due to a sudden change in ink flow speed, the diameter of the center portion of the a above-described filter is preferably greater than the size of the cross-section of the ink guiding path of the recording head, on the inward side of the filter.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described in detail with reference to the appended drawings. Here, emphasis will be placed upon the differences between the present invention and the conventional art.

(Embodiment 1)

Figure 1:
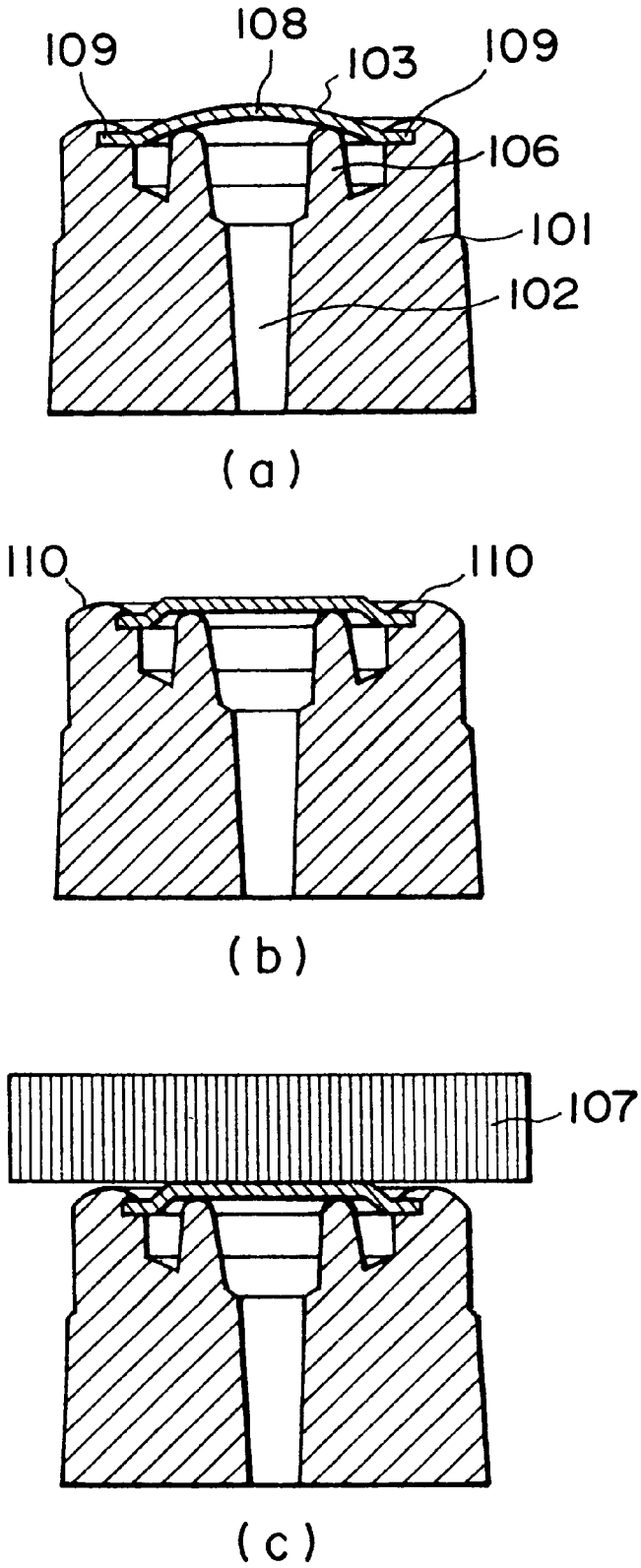
FIG. 1(*a*) is a sectional view of the ink inlet portion of an inkjet recording head, after the welding of the filter thereto, in the first embodiment of the present invention, FIG. 1(*b*) showing the state in which the filter has been deformed by being pressed, and FIG. 1(*c*) showing the state of contact between the filter and pressing member.

FIG. 1 is a sectional view of the ink inlet portion of the recording head in the first embodiment of the present invention. The inkjet recording head in this embodiment has an ink inlet path (liquid flow path) 102, which is in the cylindrical ink inlet 101 of the inkjet recording head. To the outward end of the ink inlet path 102, a filter 103 has been thermally welded, beneath upstream edge 110 of ink inlet 101. More specifically, the outward end of the ink inlet is provided with two types of ribs (unshown) which are located at the peripheral portion of the outward end of the ink inlet path 102. To the ribs of one type, the filter 103 is welded. The ribs of the other type cover the periphery of the filter 103 in such a manner as to wrap it. These ribs constitute the portions to which the filter 103 is fixed. The outward end of the ink inlet is also provided with a plurality of pillars 106, which are configured to support the filter 103 from the inward side of the filter 103 as the filter 103 is fixed to the outward end of the ink inlet at its periphery. Before the filter 103 is attached to the ink inlet of the recording head, its center portion 108 spherically bulges in the direction correspondent to the outward direction of the ink inlet, whereas its peripheral portion 109 is rendered flat. After the filter 103 is placed in the slightly recessed portion of the end portion of the ink inlet of the recording head, it is fixed to the outward end of the ink inlet portion, by thermally deforming the aforementioned ribs located at the periphery of the ink inlet, that is, those constituting the filter fixing portion (FIG. 1(*a*)).

Referring to FIGS. 1(*b*) and 1(*c*), after the filter 103 is welded to the ink inlet portion of the recording head, the center portion of the filter 103, which is the portion of the filter 103 by which the filter 103 contacts the contact surface of the pressing member 107 formed of bound PP fibers, and is spherically protruding outward from the ink inlet of the recording head, is flattened by pressing. With this method, it is possible to give the filter 103 such a configuration that is impossible to realize unless the filter 103 is attached to the ink inlet of the recording head in accordance with the present invention. In other words, according to this embodiment of the present invention, the pressing member 107 and filter 103 can be properly placed in contact with each other regardless of the hardness of the contact surface of the pressing member 107. The distance by which the center portion of the filter 103 is pressed is adjusted so that the portion of the center portion of the filter 103, which will be flattened by pressing, will extend farther outward than the peripheral portion of the filter 103 after the flattening.

The diameter of the ink inlet path 102, on the immediately inward side of the filter 103, is rendered smaller than the diameter of the flat portion of the outward end of the ink inlet of the recording head, which the pressing member 107 contacts. Therefore, it is further assured that even when the velocity at which ink flows through the ink flow path suddenly changes due to the execution of the recording head performance recovery process in which ink is aggressively suctioned, air bubbles are not suctioned into the ink path.

(Embodiment 2)

Figure 2:
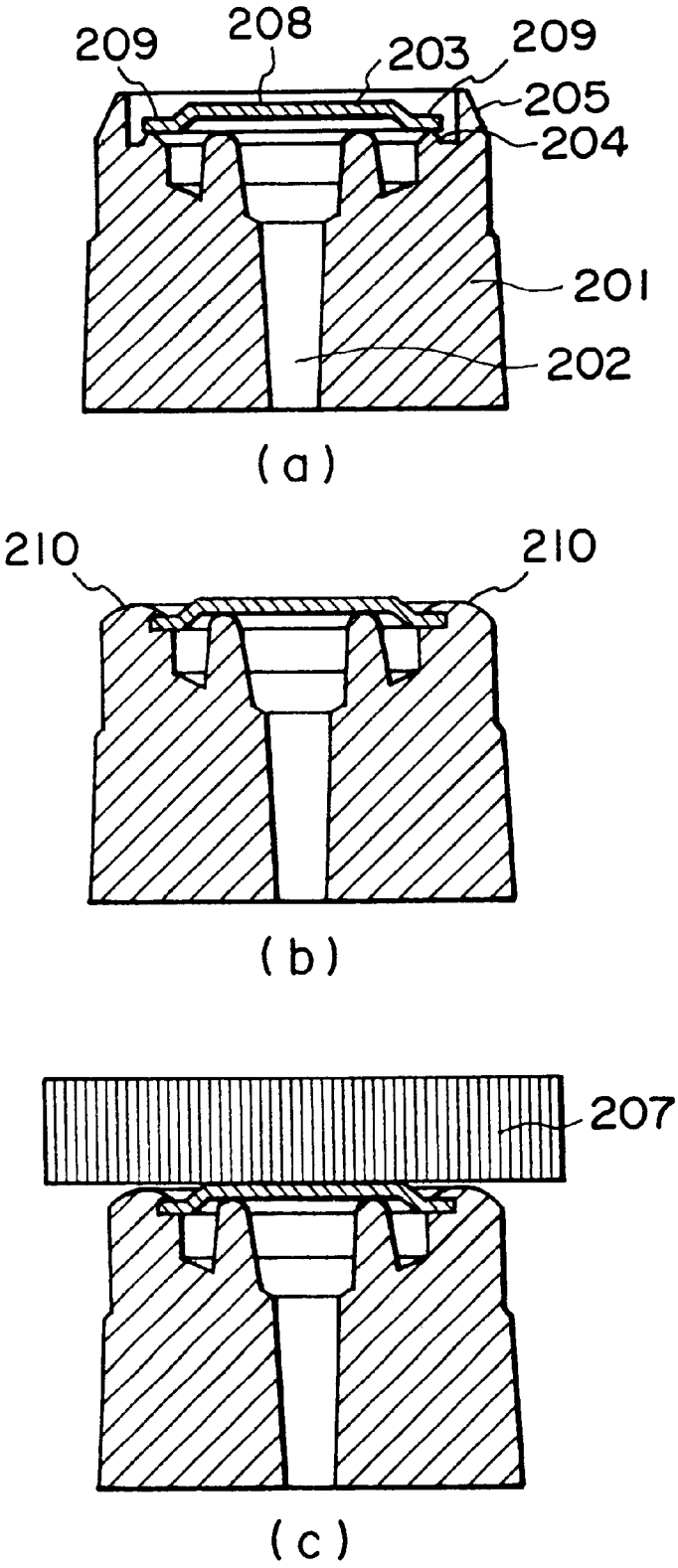
FIG. 2(*a*) is a sectional view of the ink inlet portion of an inkjet recording head, and the filter therefor, in the second embodiment of the present invention, FIG. 2(*b*) showing the state after the welding of the filter thereto, and FIG. 2(*c*) showing the state of contact between the filter and pressing member.
Figure 3:
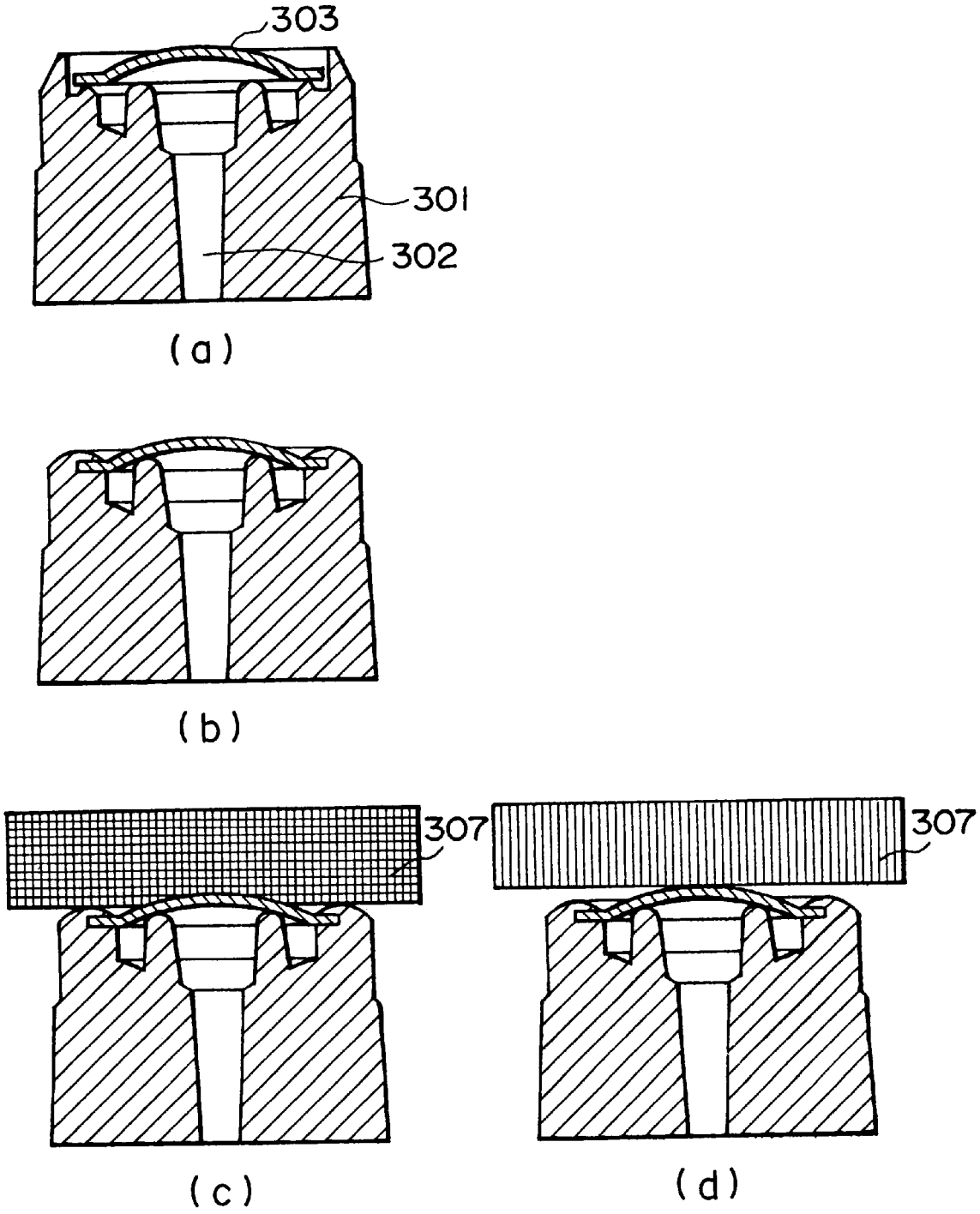
FIG. 3 PRIOR ART
FIG. 3(*a*) is a sectional view of a conventional filter before its welding, FIG. 3(*b*) showing the state after the welding of the conventional filter, and FIGS. 3(*c*) and 3(*d*) showing the state of contact between the conventional filter and pressing member.
Figure 4:
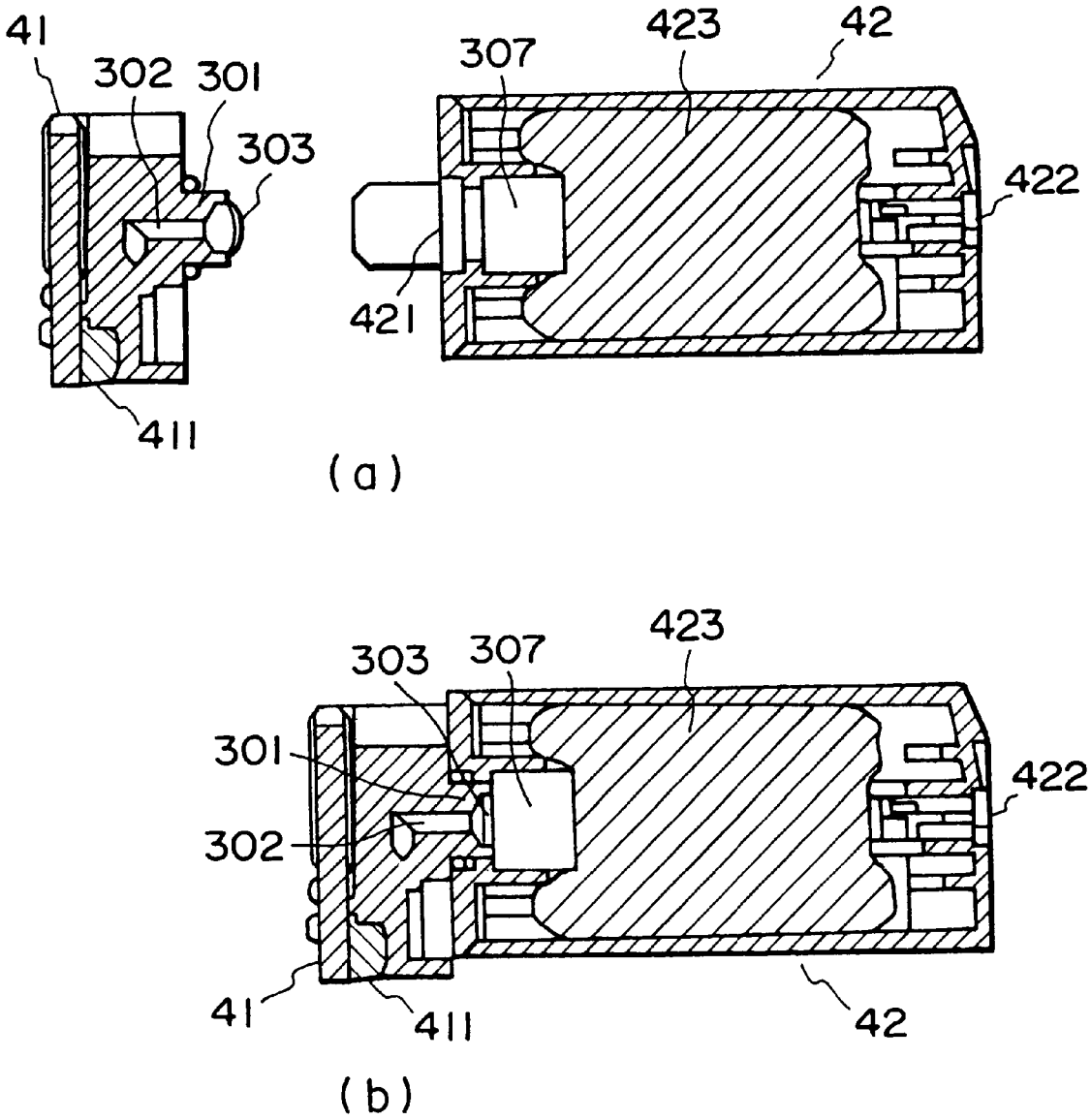
FIG. 4 PRIOR ART
FIG. 4 is a schematic sectional view of the entirety of a cartridge, the recording head and ink container of which are independent from each other, FIG. 4(*a*) showing the state in which the recording head and ink container have been separated from each other, and FIG. 4(*b*) showing the state in which the recording head and ink container have been properly connected.

FIG. 2 is a sectional view of the ink inlet of the recording head in the second embodiment of the present invention. The inkjet recording head in this embodiment is provided with an ink inlet path 202, which is located within the cylindrical ink inlet portion 201 of the recording head. The outward end of the ink inlet path 202 is provided with a filter 203, which is thermally welded beneath upstream edge 210 of ink inlet portion 201. Filter 203 has a center portion 208 and a peripheral portion 209. When filter 203 is large in diameter, it can be shaped so that its center portion 208 protrudes outward in the form of a frustum, being flat at the center portion, before its thermal welding to the recording head. In other words, the portion of the outwardly protruding portion of the filter 203, which contacts the pressing member, is rendered flat, eliminating the need for pressing the filter 203 to flatten its center portion after the welding of the filter 203 (FIG. 2(*a*)). Thus, in this embodiment, the filter 203 can be attached to the cylindrical ink inlet portion 201 of the recording head by thermally deforming the cover rib 205 after properly positioning the filter 203, which is flat across its contact portion, or the center portion, relative to the ink inlet portion 201 (FIG. 2(*b*)).

With the above described structural arrangement, the filter 203 and the pressing member 207 can be kept properly in contact with each other, regardless of the surface hardness of the pressing member 207 (FIG. 2(*c*)).

Incidentally, regarding the type of the inkjet recording heads in the embodiments of the present invention, the present invention is applicable not only to an inkjet recording head which ejects liquid droplets from its nozzles by using the film boiling phenomenon which occurs as thermal energy is applied to liquid, but also to an inkjet recording head which ejects liquid from its nozzles by means of microscopic displacement which occurs to elements in the form of a thin film, as an electrical signal is inputted into the elements.

As described above, according to the present invention which relates to a liquid ejection recording head having a liquid inlet, through which the head is supplied with the liquid from the liquid outlet, comprising a pressing member formed of fibers, of an ink container, and a filter with which the liquid inlet is fitted, the filter is shaped like a frustum so that the portion of the filter that contacts the pressing member projects outward relative to the peripheral portion of the filter by which the filter is fixed to the liquid inlet, and also becomes virtually flat, making it possible for the filter to remain properly in contact with the flat contact surface of the pressing member. Therefore, it is possible to obtain a liquid ejection recording head which is reliable in terms of filter performance (regarding the capillary force of the pressing member), and is excellent in terms of stability of ink supply.

The present invention is particularly effective when applied to a liquid ejection recording head which is connected to a liquid container, the pressing member of which is formed of fibers bound in parallel. Needless to say, it is not contradictory to the gist of the present invention to apply the present invention to a liquid ejection recording head which is connected to a liquid container, the pressing member of which is formed of a relatively soft fibrous material such as felt.

Further, the present invention is effectively applicable to a liquid ejection recording head which employs a hard filter produced by sintering. However, the application of the present invention to a filter produced by weaving metallic fibers is also not contradictory to the gist of the present invention.

Of various combinations between pressing members and filters, the combination that best exploits the present invention is the combination of a pressing member formed of fibers bound in parallel, and a sintered filter. However, the present invention is also applicable to a combination of a pressing member formed of fibers bound in parallel, and a filter formed of woven metallic fibers, or a combination of pressing member formed of felt or the like, and a sintered filter or a metallic fiber filter.

While the invention has been described with reference to the structures disclosed herein, it is not confined to the details set forth and this application is intended to cover such modifications or changes as may come within the purpose of the improvements or the scope of the following claims.

What is claimed is:

1. A liquid ejection recording head which receives liquid from one or more liquid containers mountable on a carriage, each said liquid container having a press-contact member of fibrous material at a liquid outlet, said liquid ejection recording head comprising:

a tubular member for receiving ink from said liquid container, said tubular member having an upstream edge with respect to a direction of flow of the liquid therethrough and having a fixing portion;

a filter having a peripheral portion and being fixed to said tubular member by having said peripheral portion sandwiched by said fixing portion of said tubular member downstream of said upstream edge with respect to the direction of flow of the liquid, wherein a region of said filter other than said peripheral portion sandwiched by said fixing portion is stepped outwardly from said tubular member and constitutes a substantially flat portion which extends slightly outward from said upstream edge; and a plurality of pillars disposed in said tubular member and having end portions contacted to a backside of said substantially flat portion of said filter.

2. A liquid ejection recording head according to claim 1, wherein said filter is a sintered compact of metal fibers.

3. A liquid ejection recording head according to claim 1 or 2, wherein said filter per se in a free state comprises a central portion and said peripheral portion, and said central portion constitutes a substantially flat surface which is stepped up from said peripheral portion.

4. A liquid ejection recording head according to claim 1 or 2, wherein said filter per se in a free state comprises a central portion and said peripheral portion, and said central portion constitutes a convex surface, which is flattened to provide a substantially flat surface by pressing said convex surface after said peripheral portion is secured to said tubular member.

5. A liquid ejection recording head according to claim 1 or 2, wherein said substantially flat portion has a diameter that is larger than an inner diameter of said tubular member at a backside of said filter.

6. A liquid ejection recording head according to claim 2, wherein said press-contact member comprises a bundle of unidirectional fibers.

7. A liquid ejection recording head according to claim 2, wherein said press-contact member comprises felt.

8. A liquid ejection recording head according to claim 1, wherein said press-contact member comprises a bundle of unidirectional fibers.

9. A liquid ejection recording head according to claim 1, wherein said press-contact member comprises felt.

* * * * *